US010811804B1

(12) United States Patent
Probert et al.

(10) Patent No.: US 10,811,804 B1
(45) Date of Patent: Oct. 20, 2020

(54) ELECTRIC TERMINAL CONNECTOR ASSEMBLY WITH A TERMINAL LOCK

(71) Applicant: Lear Corporation, Southfield, MI (US)

(72) Inventors: Deborah Probert, Farmington Hills, MI (US); Michael Glick, Winston-Salem, NC (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/507,941

(22) Filed: Jul. 10, 2019

(51) Int. Cl.
*H01R 13/424* (2006.01)

(52) U.S. Cl.
CPC ..... *H01R 13/424* (2013.01)

(58) Field of Classification Search
CPC ..... H01R 13/424; H01R 13/4362
USPC ..... 439/744, 595, 752, 352, 745
See application file for complete search history.

(56) References Cited

U.S. PATENT DOCUMENTS 5,069,639 A * 12/1991 Kodama ..... H01R 13/4365 439/594
5,085,599 A * 2/1992 Maejima ..... H01R 13/4365 439/595
5,281,168 A 1/1994 Krehbiel et al.
6,132,252 A * 10/2000 Chaillot ..... H01R 13/4365 439/595
6,935,893 B1 8/2005 Flowers et al.
8,231,409 B2 * 7/2012 Lebrun ..... H01R 13/4365 439/595
8,651,901 B2 2/2014 Beck, Jr. et al.
9,673,553 B1 6/2017 Upson
9,819,111 B2 11/2017 Holub et al.
10,193,247 B1 1/2019 Glick et al.

* cited by examiner

*Primary Examiner* — Travis S Chambers
(74) *Attorney, Agent, or Firm* — MacMillan, Sobanski & Todd, LLC

(57) ABSTRACT

A connector assembly includes a connector housing that defines a terminal cavity that extends along a cavity axis. A terminal lock is adapted to retain an electric terminal in the terminal cavity in an installed position. The terminal lock includes a lock arm that extends from the connector housing and a lock tab that extends from the lock arm into the terminal cavity. The connector assembly also includes a terminal position assurance that is attached to the connector housing for relative movement between a pre-lock position and a lock position. When the terminal position assurance is in the lock position, it limits movement of the terminal lock away from the cavity axis and it limits movement of the terminal lock toward the cavity axis.

8 Claims, 9 Drawing Sheets

ELECTRIC TERMINAL CONNECTOR ASSEMBLY WITH A TERMINAL LOCK

BACKGROUND OF THE INVENTION

This invention relates to a connector assembly for an electric terminal. More specifically, this invention relates to a connector assembly for an electric terminal including a terminal lock that provides improved resistance to the terminal being pulled out of a connector housing.

Electric terminals are used in a variety of applications where it is desirable to create an electric connection between various components of a circuit. Electric terminals are typically installed in a housing for ease of use. The housing holds each electric terminal in a desired position and orientation and allows a user to easily connect each electric terminal to its respective mate.

Terminal locks holds each electric terminal in the housing and ensure that the electric terminals do not fall out of the cavity during normal use. A typical terminal lock includes a resilient arm that engages the body of the electric terminal when the electric terminal is installed in the housing. The electric terminal engages the arm if a force is applied to pull it out of the housing, and this engagement resists such movement of the electric terminal.

A terminal position assurance is commonly used to ensure that each of the electric terminals is properly installed in the housing. The terminal position assurance is a component that mates with the housing and is located in a lock position when all of the electric terminals are properly installed in the housing. If one or more of the electric terminals is not properly installed in the housing, the terminal position assurance is prevented from moving to the lock position.

A vehicle such as a passenger car includes a number of different electric components. In order to ensure that these electric components operate correctly throughout the life of the vehicle, it is desirable that the electric terminals remain properly installed in the housing and are not accidentally pulled out of the housing. It would be advantageous to have an alternative connector assembly that prevents the electric terminals from being pulled out of the housing.

SUMMARY OF THE INVENTION

This invention relates to a connector assembly. The connector assembly includes a connector housing. The connector housing defines a terminal cavity that extends along a cavity axis. A terminal lock is adapted to retain an electric terminal in the terminal cavity in an installed position. The terminal lock includes a lock arm that extends from the connector housing and a lock tab that extends from the lock arm into the terminal cavity. The connector assembly also includes a terminal position assurance. The terminal position assurance is attached to the connector housing for relative movement between pre-lock position and a lock position. When the terminal position assurance is in the lock position, it limits movement of the terminal lock away from the cavity axis. When the terminal position assurance is in the lock position, it limits movement of the terminal lock toward the cavity axis.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
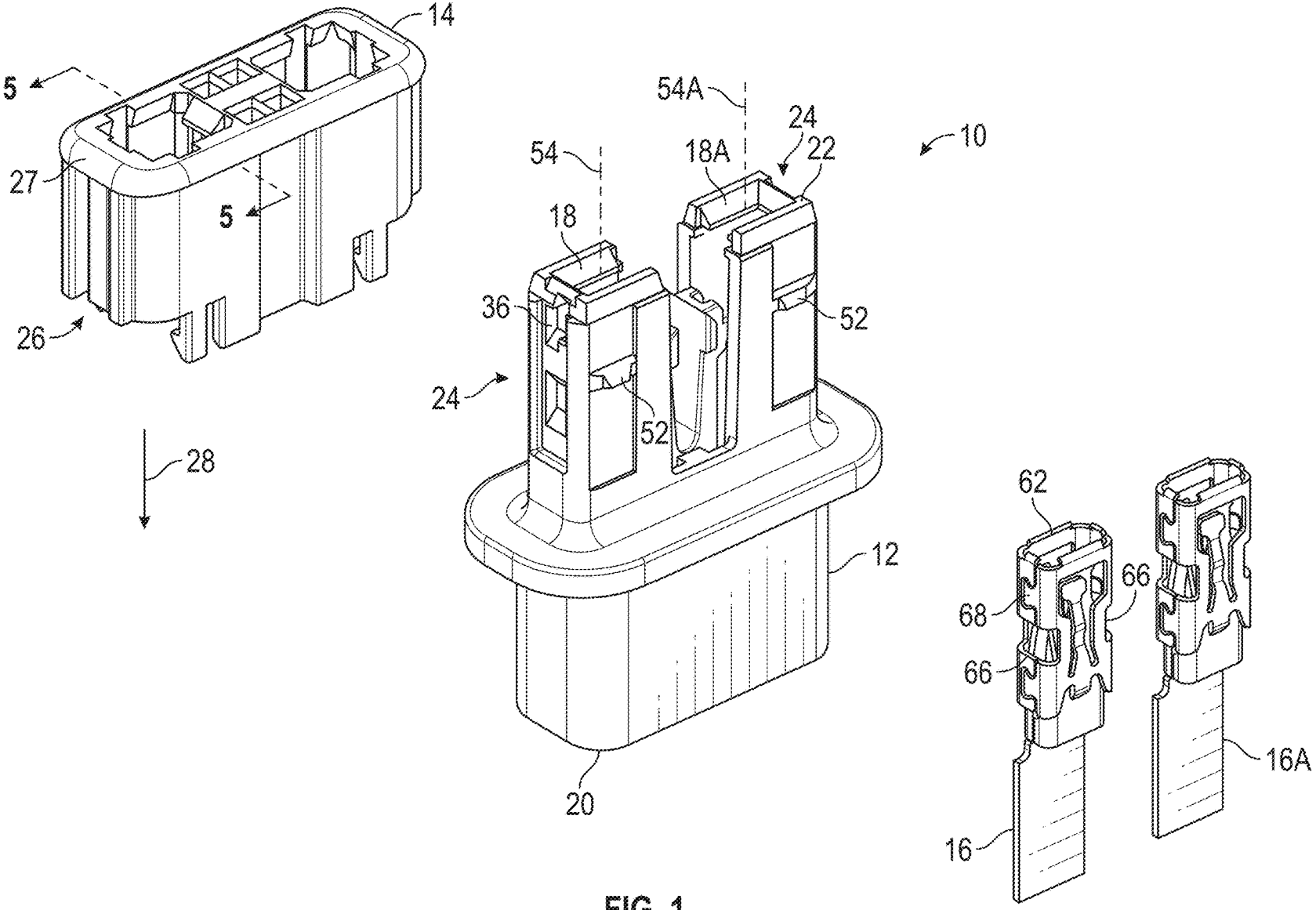
FIG. 1 is an exploded perspective view of a connector assembly and two electric terminals.

Referring now to the drawings, there is illustrated in FIG. 1 an exploded perspective view of a connector assembly indicated generally at 10. The connector assembly 10 includes a housing 12 and a terminal position assurance 14. The connector assembly 10 is adapted to hold a first electric terminal 16 and a second electric terminal 16A in a first terminal cavity 18 and a second terminal cavity 18A, respectively. The terminal cavities 18 and 18A extend through the housing 12 from an insertion end 20 of the housing 12 to a mate end 22. The illustrated electric terminals 16 and 16A are box-shaped female terminals, but the connector assembly 10 may be adapted to hold any desired type of electric terminal. Further, the connector assembly 10 may hold any desired number of electric terminals.

Figure 2:
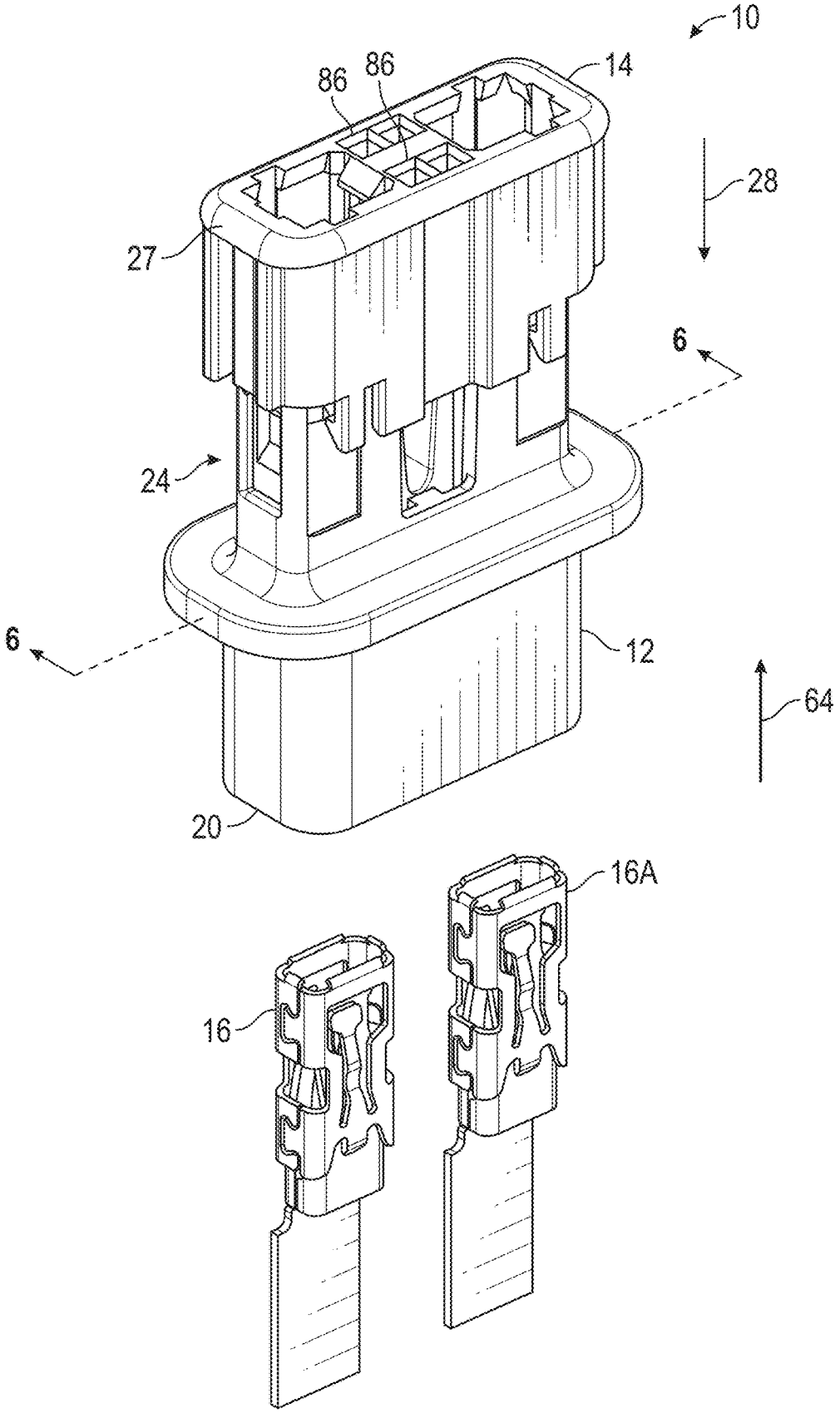
FIG. 2 is a perspective view of the connector assembly shown in a pre-lock position.
Figure 3:
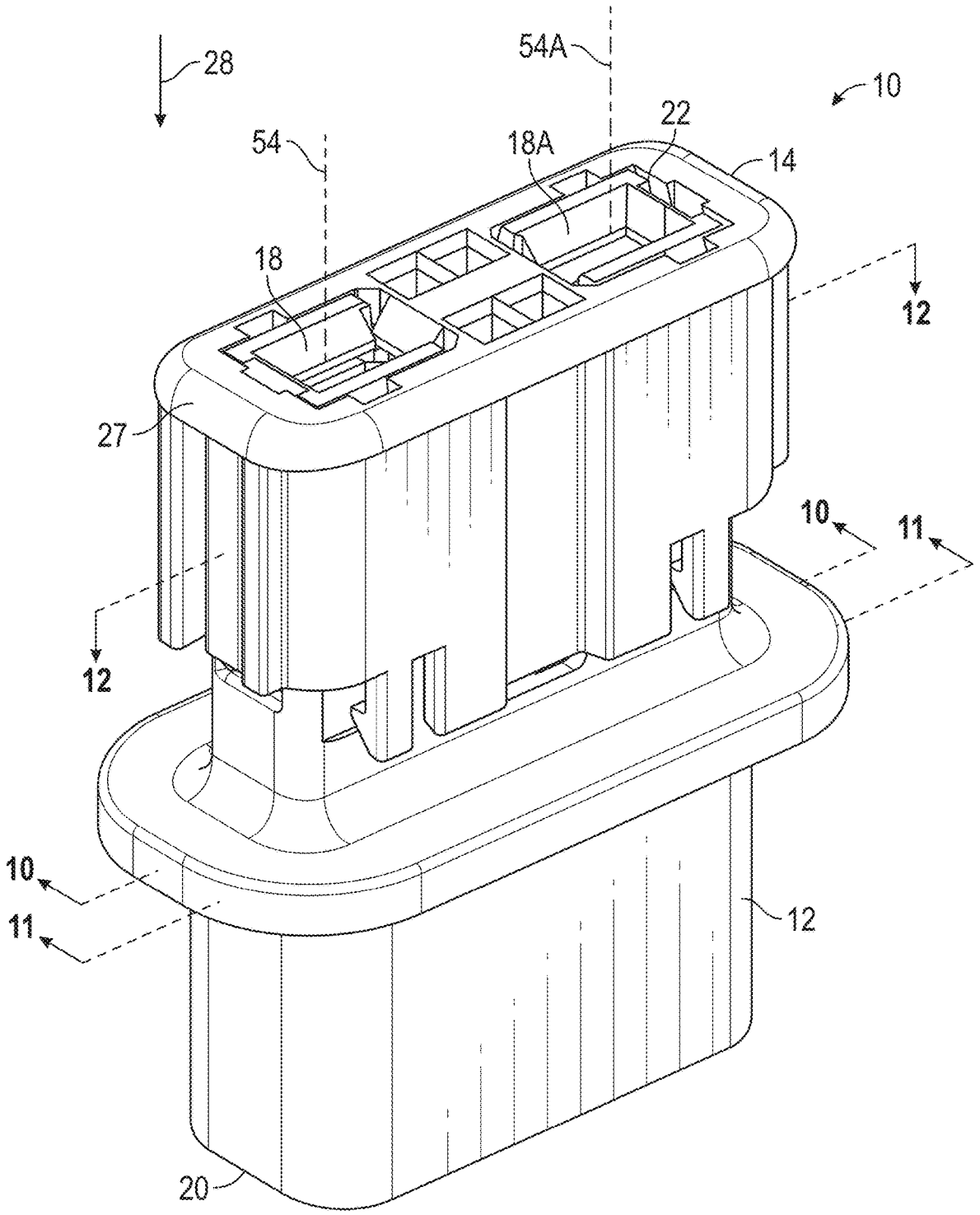
FIG. 3 is a perspective view of the connector assembly shown in a lock position.

Referring to FIG. 2, there is illustrated a perspective view of the connector assembly 10 wherein the terminal position assurance 14 is attached to the housing 12 and is located in a pre-lock position. FIG. 3 is a view of the connector assembly 10 wherein the terminal position assurance 14 has been moved relative to the housing 12 from the pre-lock position to a lock position. Both of these positions will be described in detail below.

Figure 4:
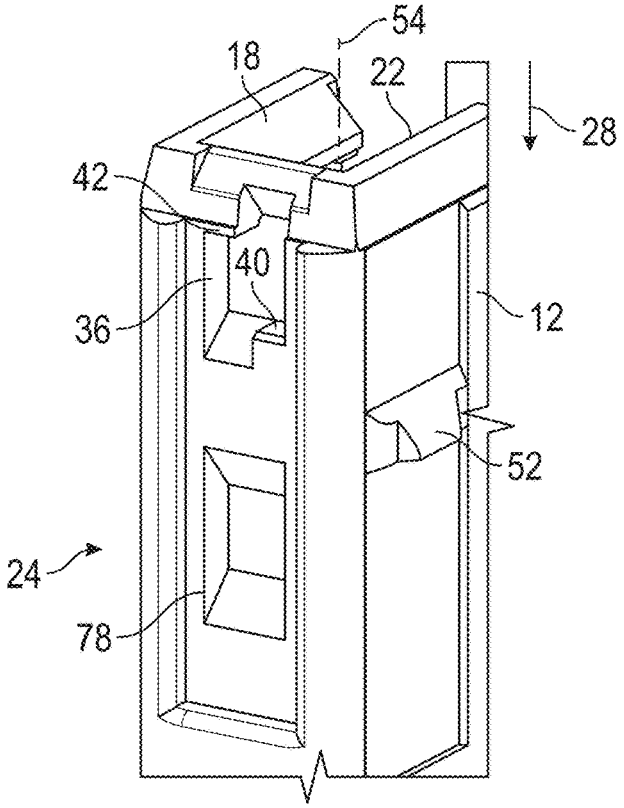
FIG. 4 is an enlarged perspective view of a portion of a housing of the connector assembly showing a housing lock.
Figure 5:
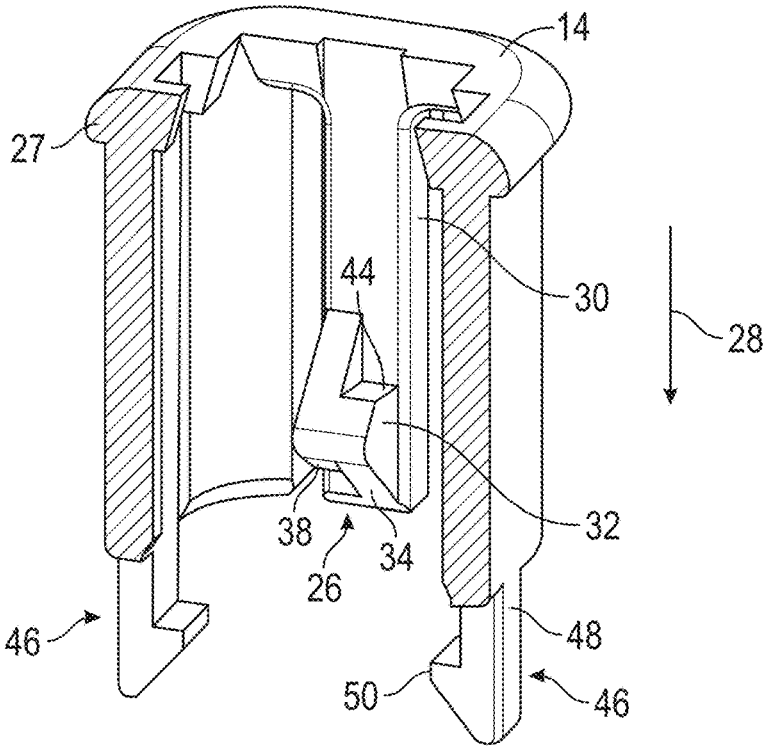
FIG. 5 is an enlarged perspective view, partially cut away, of a terminal position assurance of the connector assembly showing a terminal position assurance lock.

Referring to FIG. 4, there is illustrated a detailed view of a part of the housing 12 that includes a housing lock, indicated generally at 24. The illustrated housing 12 includes two housing locks 24 (shown on FIG. 1), but may include any desired number of housing locks 24. FIG. 5 is an enlarged, partially cut away view of a portion of the terminal position assurance 14 showing a terminal position assurance lock, indicated generally at 26. The terminal position assurance 14 includes a terminal position assurance body 27 and the terminal position assurance lock 26 extends from the terminal position assurance body 27 in a mate direction 28. The illustrated terminal position assurance 14 includes two terminal position assurance locks 26 (shown on FIG. 1), but may include any desired number. The housing lock 24 and the terminal position assurance lock 26 serve to retain the terminal position assurance 14 in one of a plurality of positions relative to the housing 12.

In order to attach the terminal position assurance 14 to the housing 12, the terminal position assurance 14 is placed in an initial position adjacent to the mate end 22 of the housing 12 with the terminal position assurance locks 26 extending toward the housing 12. The terminal position assurance 14 is then moved in the mate direction 28 relative to the housing 12 to the pre-lock position illustrated in FIG. 2. Referring to FIG. 5, the terminal position assurance lock 26 includes a resilient arm 30 that extends from the terminal position assurance body 27 and a lock head 32 that extends from the arm 30. The lock head 32 includes an insert slide 34 that is located on a side of the lock head 32 that faces in the mate direction 28. When the terminal position assurance 14 is moved from the initial position toward the pre-lock position, the insert slide 34 engages the housing 12, causing the arm 30 to deflect and move the lock head 32 away from the housing 12. Referring to FIG. 4, the housing lock 24 includes a pre-lock catch 36. When the terminal position assurance 14 is moved to the pre-lock position, the arm 30 rebounds, and the lock head 32 is moved into the pre-lock catch 36. The connector assembly 10 is then in the pre-lock position illustrated in FIG. 2.

The connector assembly 10 includes features to retain the connector assembly 10 in the pre-lock position that will be described below. The terminal position assurance 14 is prevented from being moved in the mate direction 28 relative to the housing 12 when the connector assembly 10 is in the pre-lock position. The terminal position assurance 14 is also prevented from being moved opposite the mate direction 28 relative to the housing 12 when the connector assembly 10 is in the pre-lock position.

Figure 6:
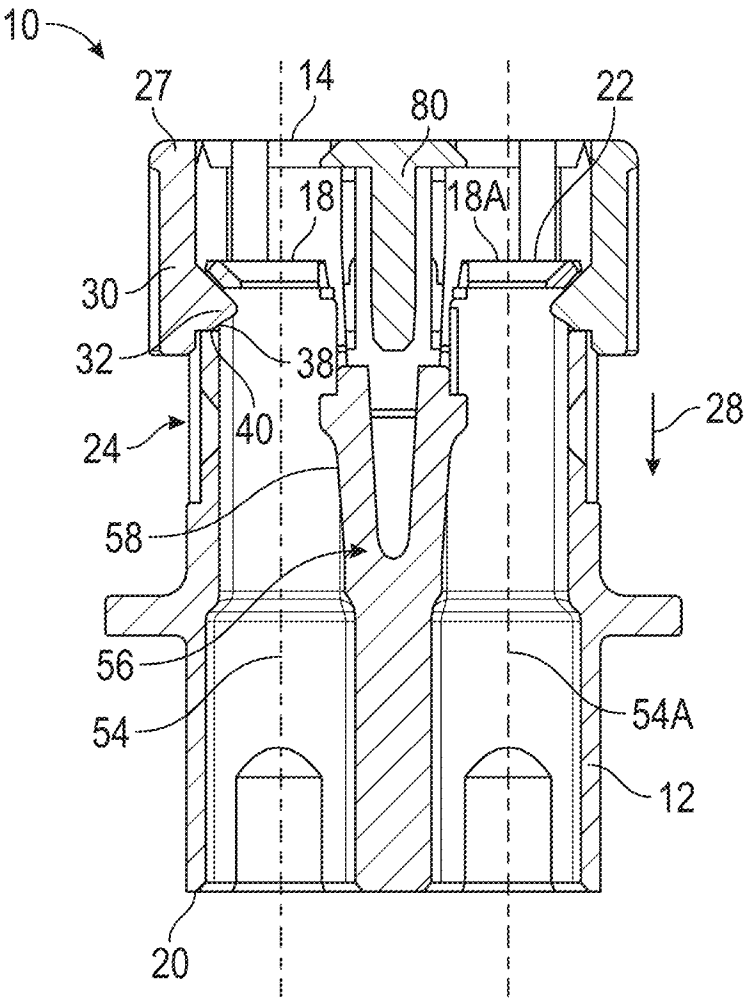
FIG. 6 is a cross-sectional view of the connector assembly taken along line 6-6 of FIG. 2.

Referring back to FIG. 5, the lock head 32 includes an insert stop 38 on the side of the lock head 32 that faces in the mate direction 28. The insert stop 38 is located adjacent to the insert slide 34 and has a different slope than the insert slide 34. Referring to FIG. 4, the housing lock 24 includes an insert block 40 on the pre-lock catch 36. When the connector assembly 10 is in the pre-lock position, the insert stop 38 is located adjacent to the insert block 40. FIG. 6 is a cross-sectional view taken along line 6-6 of FIG. 2 and is taken through the insert stop 38 and the insert block 40. As shown, the insert stop 38 engages the insert block 40 to prevent further movement of the terminal position assurance 14 in the mate direction 28 relative to the housing 12.

Referring back to FIG. 5, the lock head 32 includes a removal stop 44 on the side of the lock head 32 that faces opposite the mate direction 28. The removal stop 44 is located on the opposite side of the lock head 32 from the insert stop 38. Referring to FIG. 4, the housing lock 24 includes a removal block 42 on the pre-lock catch 36. The removal block 42 is located on the opposite side of the pre-lock catch 36 from the insert block 40. When the connector assembly 10 is in the pre-lock position, the removal stop 44 is located adjacent to the removal block 42, and the removal stop 44 engages the removal block 42 to prevent movement of the terminal position assurance 14 opposite the mate direction 28 relative to the housing 12.

The terminal position assurance 14 also includes a plurality of retainer latches, indicated generally at 46. The illustrated terminal position assurance 14 includes four retainer latches 46, and two are shown in FIG. 5. However, the terminal position assurance 14 may include any desired number of retainer latches 46. Each retainer latch 46 includes a resilient latch arm 48 that extends from the terminal position assurance body 27 and a latch tab 50 that extends from the latch arm 48. The housing 12 includes a plurality of retainer catches 52. The illustrated housing 12 includes four retainer catches 52, and one is shown in FIG. 4. When the connector assembly 10 is in the pre-lock position, each of the retainer latches 46 engages one of the retainer catches 52 to prevent the terminal position assurance 14 from being moved opposite the mate direction 28 relative to the housing 12.

As previously described and as shown in FIG. 6, the terminal cavity 18 extends from the insertion end 20 to the mate end 22 of the housing 12. The housing 12 extends along a cavity axis 54. The second terminal cavity 18A similarly extends along a cavity axis 54A. The illustrated second terminal cavity 18A includes the same features as the terminal cavity 18 and will not be described separately. The terminal cavity 18 includes a terminal lock, indicated generally at 56, that serves to retain the electric terminal 16 in an installed position in the terminal cavity 18. The terminal lock 56 includes a resilient lock arm 58 and a lock tab 60 that extends from the lock arm 58 toward the cavity axis 54.

Referring to FIG. 2, in order to insert the electric terminal 16 into the terminal cavity 18, the electric terminal 16 is initially positioned with a mate end 62 adjacent to the insertion end 20 of the housing 12. The electric terminal 16 is then moved in an insertion direction 64 relative to the housing 12 and into the terminal cavity 18. In the illustrated embodiment, the insertion direction 64 is opposite the mate direction 28. However, the insertion direction 64 may have any desired orientation.

Figure 7:
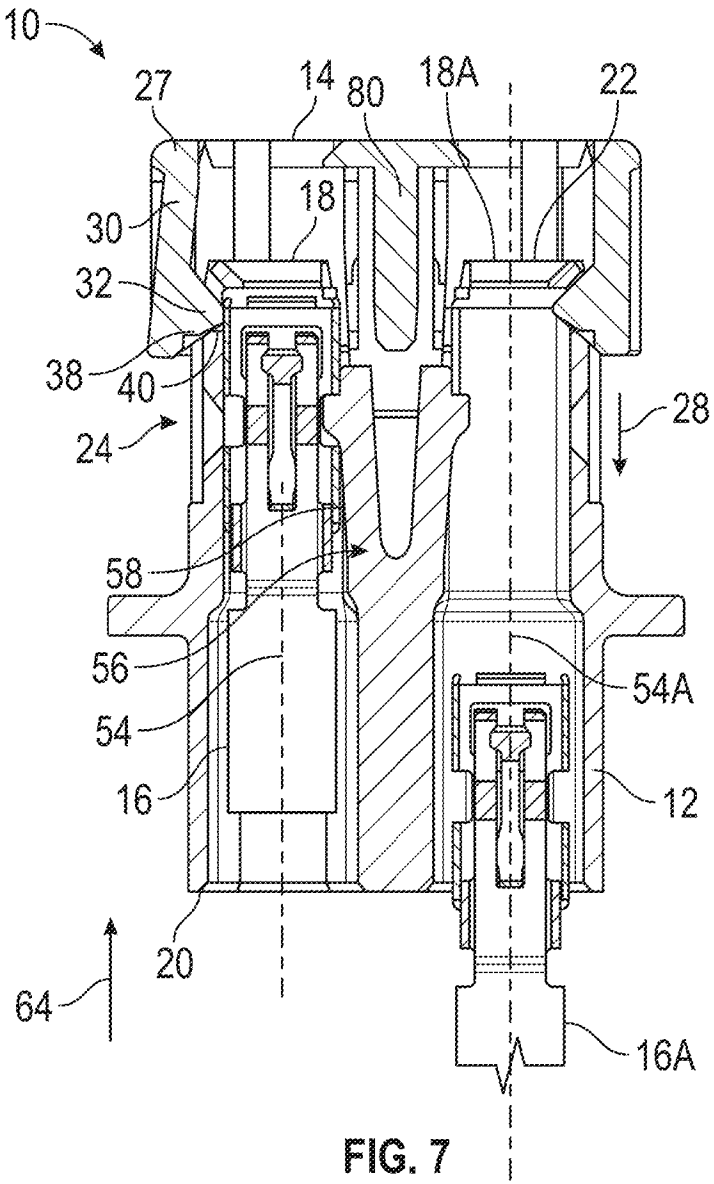
FIG. 7 is a cross-sectional view similar to FIG. 6, showing the housing with one of the electric terminals in an installed position.

As the electric terminal 16 is moved in the insertion direction 64 relative to the housing 12, it engages the terminal lock 56 and pushes the lock tab 60 away from the cavity axis 54. The illustrated electric terminal 16 is similar to the terminal described in U.S. Pat. No. 10,193,247, but includes two lock windows 66 on opposed sides thereof. The illustrated lock windows 66 are located in a spring 68 of the electric terminal 16, but may be located in any desired part of the electric terminal 16. When the electric terminal 16 is moved in the insertion direction 64 to the installed position, the terminal lock 56 rebounds toward the cavity axis 54, and the lock tab 60 is moved into one of the lock windows 66. This is illustrated in FIG. 7, which is a cross-sectional view similar to FIG. 6 with the electric terminal 16 shown in the installed position. When the electric terminal 16 is in the installed position, the electric terminal 16 engages the terminal lock 56 to prevent the electric terminal 16 from being moved opposite the insertion direction 64 relative to the housing 12.

Figure 8:
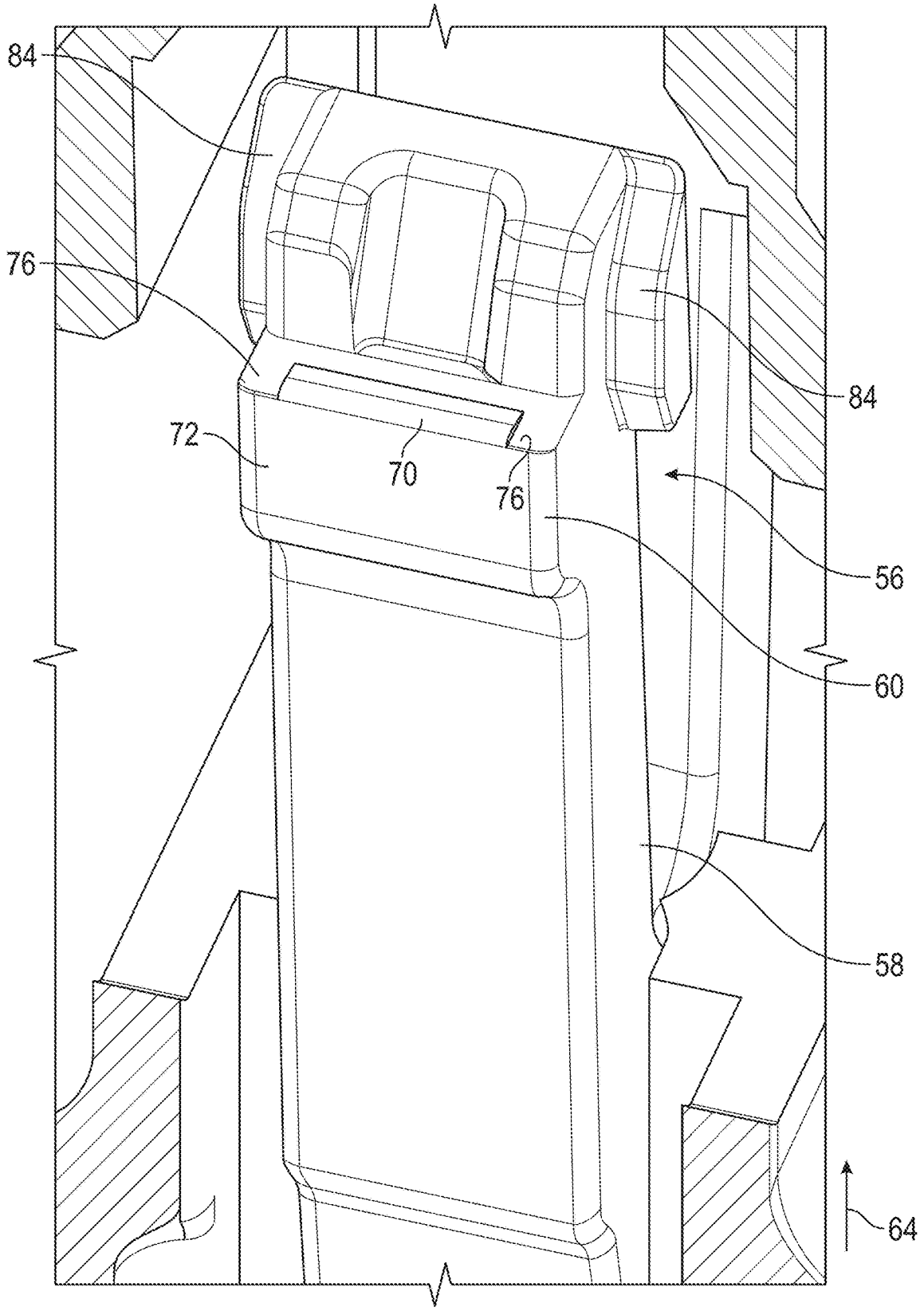
FIG. 8 is an enlarged perspective view of a terminal lock of the housing.
Figure 9:
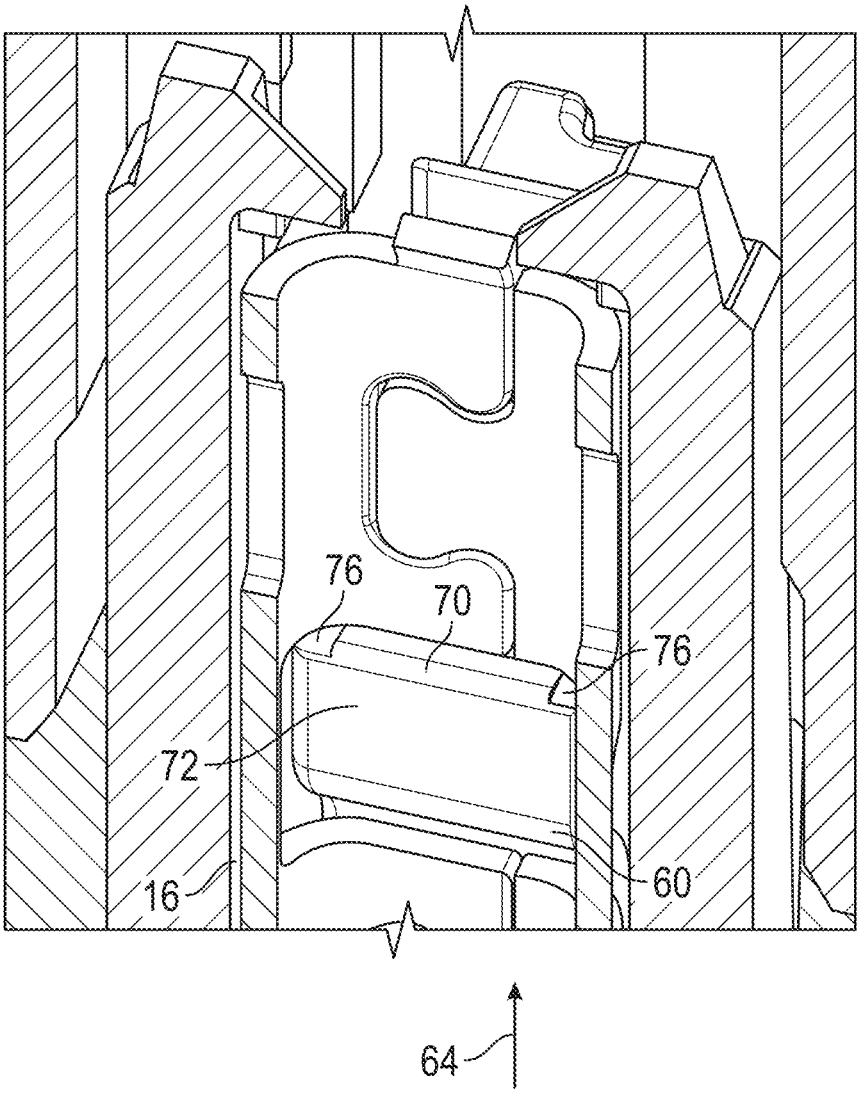
FIG. 9 is an enlarged perspective view, partially cut away, of one of the electric terminals seated on the terminal lock.

Referring now to FIG. 8, there is illustrated a partially cut away view of the housing 12 showing the terminal lock 56. FIG. 9 is a view similar to FIG. 8, showing a cut away view of the electric terminal 16 in the installed position on the terminal lock 56. As previously described, the lock tab 60 extends from the lock arm 58. The lock tab 60 includes a raised ridge 70 on an outer end 72 thereof, away from the lock arm 58. The outer end 72 has a width that is larger than the ridge 70 and includes a flat 76 on either side of the ridge 70. When the electric terminal 16 is in the installed position, the ridge 70 is located inside the electric terminal 16 as shown in FIG. 9, and the electric terminal 16 is seated, in part, on the flats 76. As a result, the ridge 70 positions the electric terminal 16 on the lock tab 60 so that the electric terminal 16 is in contact with the lock tab 60 across the width.

Referring back to FIG. 7, when the electric terminal 16 is in the installed position, it releases the terminal position assurance lock 26 from the pre-lock catch 36. As shown, the electric terminal 16 engages the lock head 32, and the lock head 32 is pushed away from the cavity axis 54 and out of the pre-lock catch 36. As a result, the insert stop 38 will not engage the insert block 40 and will not prevent further movement of the terminal position assurance 14 in the mate direction 28 relative to the housing 12. In the illustrated embodiment, the terminal position assurance 14 will be locked in the pre-lock position until the second electric terminal 16A is also placed in an installed position. When the second electric terminal 16A is placed in the installed position, the terminal position assurance 14 will be able to be moved in the mate direction 28 relative to the housing 12. However, the retainer latches 46 will continue to engage the respective retainer catches 52 to prevent the terminal position assurance 14 from being moved opposite the mate direction 28 relative to the housing 12.

Figure 10:
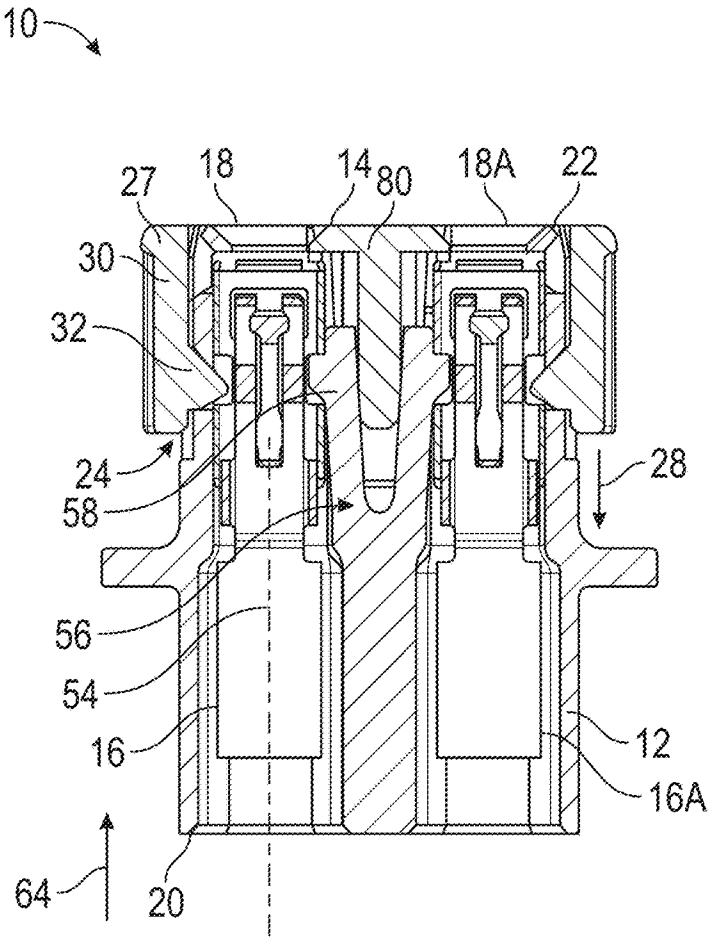
FIG. 10 is a cross-sectional view similar to FIG. 7, taken along line 10-10 of FIG. 3.

Referring to FIG. 10, there is illustrated a cross-sectional view similar to FIG. 7, with the second electric terminal 16A in the installed position and the terminal position assurance 14 moved relative to the housing 12 in the mate direction 28. The connector assembly 10 is shown in the lock position, illustrated in FIG. 3.

Referring back to FIG. 4, the housing lock 24 includes a lock catch 78. When the terminal position assurance 14 is moved to the lock position, the arm 30 rebounds, and the lock head 32 is moved into the lock catch 78. Referring to FIG. 10, the lock head 32 also extends into one of the lock windows 66 on the electric terminal 16. When the connector assembly 10 is in the lock position, the lock head 32 and the lock tab 60 are located on opposed sides of the cavity axis 54. As shown in FIG. 10, the lock head 32 engages the housing 12 to prevent the terminal position assurance 14 from being moved opposite the mate direction 28 relative to the housing 12.

The terminal position assurance 14 includes a lock stop 80 that prevents the terminal lock 56 from releasing the electric terminal 16. The lock stop 80 extends behind the lock arm 58 in order to prevent the terminal lock 56 from moving away from the cavity axis 54. Thus, when the connector assembly 10 is in the lock position, the terminal position assurance 14 prevents the terminal lock 56 from releasing the electric terminal 16 from the terminal cavity 18.

Figure 11:
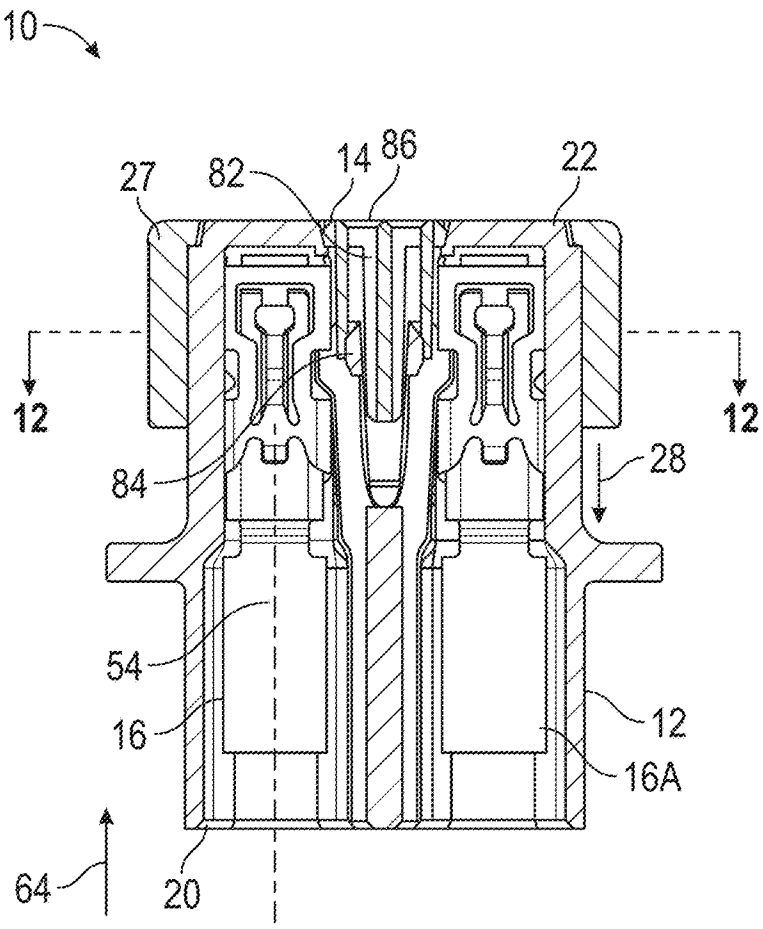
FIG. 11 is a cross-sectional view taken along line 11-11 of FIG. 3.
Figure 12:
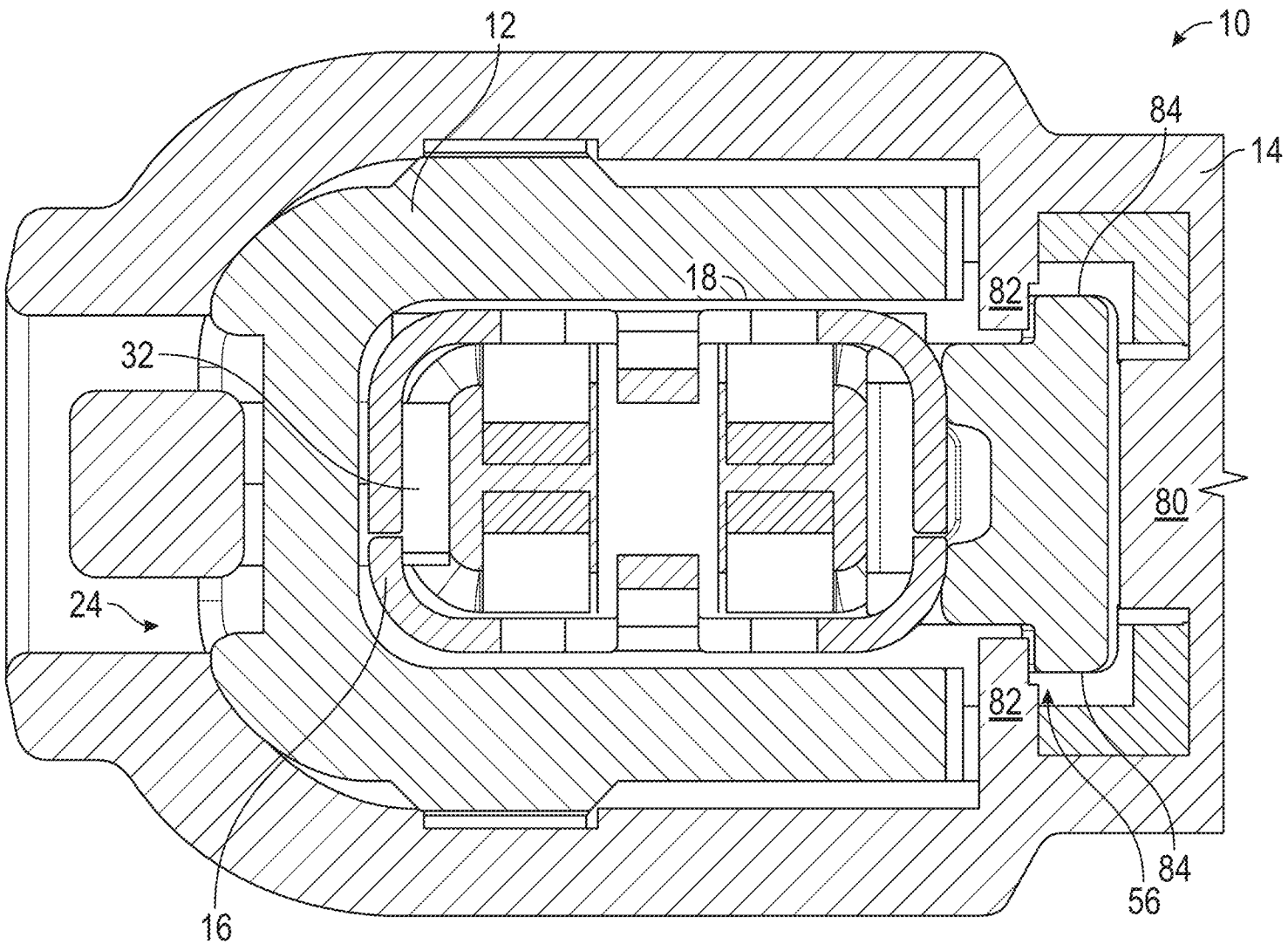
FIG. 12 is a cross-sectional view taken along line 12-12 of FIG. 3.

Referring to FIG. 11, there is illustrated a cross-sectional view taken through the connector assembly 10 in the lock position. The view illustrated in FIG. 11 is taken parallel to the view illustrated in FIG. 10. The terminal position assurance 14 also includes a forward stop 82 that prevents the terminal lock 56 from moving toward the cavity axis 54. The forward stop 82 extends from the terminal position assurance body 27 in the mate direction 28. The terminal lock 56 includes a forward block 84 that engages the forward stop 82 to prevent the terminal lock 56 from moving toward the cavity axis 54. Referring back to FIG. 8, the illustrated terminal lock 56 includes two forward blocks 84 that are located on opposite sides of the lock tab 60. However, the terminal lock 56 may have any desired number of forward blocks 84 extending in any desired locations. Referring to FIG. 12, there is illustrated a cross-sectional view taken along line 12-12 of FIG. 11. As shown, the terminal position assurance 14 includes two forward stops 82 that each extend in front of one of the forward blocks 84. Each forward stop 82 is located between the respective forward block 84 and the terminal cavity 18.

If a force is applied to the pull the electric terminal 16 out of the terminal cavity 18 in the direction opposite the insertion direction 64, such movement of the electric terminal 16 is resisted by the terminal lock 56. The electric terminal 16 engages the lock tab 60, and the electric terminal 16 is stopped from moving opposite the insertion direction 64. This applies a force that could break the lock tab 60 off of the lock arm 58, which is resisted by the shear strength of the terminal lock 56. This also applies a force to the terminal lock 56 that tends to pull the lock arm 58 toward the cavity axis 54. If the terminal lock 56 is pulled toward the cavity axis 54, the section of the terminal lock 56 that resists the shearing of the terminal lock 56 can change, which could reduce the strength of the terminal lock 56. Therefore, it is advantageous that the terminal position assurance 14 prevent the terminal lock 56 from moving toward the cavity axis 54 in order to maintain the designed strength of the terminal lock 56.

As shown in FIG. 12, when the connector assembly 10 is in the lock position, the terminal cavity 18 has a substantially rectangular shape with three walls defined by the housing 12 and one wall defined by the terminal position assurance 14. The terminal lock 56 extends into the terminal cavity 18 from the wall defined by the terminal position assurance 14. Also, the terminal position assurance 14 limits movement of the terminal lock 56 away from the cavity axis 54, and the terminal position assurance 14 limits movement of the terminal lock 56 toward the cavity axis 54.

The illustrated connector assembly 10 is also serviceable and the electric terminal 16 and the second electric terminal 16A may be removed from their respective installed positions, if desired. Referring back to FIG. 10, the electric terminal 16 is retained in the first terminal cavity 18 by the terminal lock 56, which is held in place by the lock stop 80 on the terminal position assurance 14. In order to remove the electric terminal 16 from the installed position, the terminal position assurance 14 is moved opposite the mate direction 28 relative to the housing 12 to the pre-lock position.

Referring back to FIG. 2, the terminal position assurance 14 includes first release openings 86 that extend through the terminal position assurance body 27. The illustrated terminal position assurance 14 includes two first release openings 86, but may include any desired number. A release tool (not shown) may be inserted through the first release openings 86, parallel to the cavity axis 54, to engage the terminal lock 56. In the illustrated embodiment, each first release opening 86 is aligned with one of the forward blocks 84. Referring to FIG. 8, each forward block 84 is angled so that the release tool engages the terminal lock 56, deflects the lock arm 58, and moves the lock tab 60 away from the cavity axis 54. At this point, the lock tab 60 is moved out of the lock window 66 and the electric terminal 16 may be removed from the first terminal cavity 18.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A connector assembly comprising:

a connector housing defining a terminal cavity that extends along a cavity axis;

a terminal lock adapted to retain an electric terminal in the terminal cavity in an installed position, the terminal lock including a lock arm that extends from the connector housing and a lock tab that extends from the lock arm into the terminal cavity; and a terminal position assurance attached to the connector housing for relative movement between a pre-lock position and a lock position;

wherein when the terminal position assurance is located in the lock position, it limits movement of the terminal lock both toward and away from the cavity axis.

2. The connector assembly of claim 1, wherein the terminal position assurance includes a lock stop that engages the terminal lock to prevent the terminal lock from moving away from the cavity axis, and wherein the terminal position assurance includes a forward stop that engages the terminal lock to prevent the terminal lock from moving toward the cavity axis.

3. The connector assembly of claim 1, wherein the terminal lock includes forward blocks on opposed sides of the lock tab that engage the terminal position assurance to prevent movement of the terminal lock toward the cavity axis.

4. The connector assembly of claim 1, wherein the terminal lock includes forward blocks located on opposed sides of the lock tab, and wherein the terminal position assurance includes forward stops that extend between the forward blocks and the terminal cavity when the terminal position assurance is located in the lock position.

5. The connector assembly of claim 1, wherein the terminal cavity is defined by a wall of the terminal position assurance.

6. The connector assembly of claim 5, wherein the lock arm extends from the wall of the terminal position assurance.

7. The connector assembly of claim 1, wherein the terminal position assurance includes first and second portions that are disposed on opposite sides of the terminal lock when the terminal position assurance is located in the lock position so as to limit movement of the terminal lock both toward and away from the cavity axis.

8. The connector assembly of claim 7, wherein the first portion of the terminal position assurance is a lock stop that extends adjacent to a first side of the terminal lock, and wherein the second portion of the terminal position assurance is a forward stop that extends adjacent to a second side of the terminal lock that is opposite to the first side.

* * * * *